US005921030A

United States Patent [19]

Ducotey et al.

[11] Patent Number: 5,921,030

[45] Date of Patent: Jul. 13, 1999

[54] TANK COVER

[75] Inventors: Steven M. Ducotey, Conroe; Michael L. Reynolds, Huntsville, both of Tex.

[73] Assignee: Conservatek, Inc., Couroe, Tex.

[21] Appl. No.: 09/002,975

[22] Filed: Jan. 5, 1998

[51] Int. Cl.[6] ..... E04B 1/32

[52] U.S. Cl. ..... 52/3; 52/23; 52/281; 52/483.1

[58] Field of Search ..... 52/3–5, 246, 281, 52/282.1, 283, 23, 245, 474, 483.1, 762, 763

[56] References Cited

U.S. PATENT DOCUMENTS 4,266,381 5/1981 Deller ..... 52/177
4,599,842 7/1986 Counihan ..... 52/586
5,050,361 9/1991 Hallsten ..... 52/581
5,325,646 7/1994 Hallsten et al. .
5,617,677 4/1997 Hallsten .

*Primary Examiner*—Beth A. Aubrey
*Attorney, Agent, or Firm*—Jenkens & Gilchrist, P.C.

[57] ABSTRACT

A plurality of self-supporting first and second panels are disposed in alternating arrangement along the length of an open tank. A seal is provided around the perimeter of the cover and along the joint between each of the first and second panels. Each of the first and second panels is provided with a handle at the end of each of the panels that, when in a stored position, lies flush with a walking surface provided on the top of the cover.

15 Claims, 5 Drawing Sheets

TANK COVER

BACKGROUND OF THE INVENTION

1. Technical Field

This invention relates generally to a cover for an open tank and more particularly to a sealable, substantially flat tank cover comprising a plurality of self-supporting interlocking panels.

2. History of Related Art

Sealed covers are frequently required to enclose open waste water treatment tanks, potable water tanks, gas or crude oil processing and storage tanks, drilling fluid tanks, chemical waste treatment tanks, and similar tanks used to store or process gas or odor generating fluids or sludge. The term "tank" is used herein in a generic sense, and includes above ground level tanks, below ground level basins, and combinations of above and below ground level structures. Generally, since such storage tanks have a relatively large open surface area across the top of the tank, the cover for the tank also has a relatively large surface area and is thus typically assembled in the field, desirably directly on the tank itself.

For example, sealed tank cover structures are described in U.S. Pat. No. 5,325,646, issued Jul. 5, 1994, to Jeffrey A. and John Hallsten, and U.S. Pat. No. 5,617,677, issued Apr. 8, 1997, to Jeffrey A. Hallsten. The tank cover structure described in both of the Hallsten patents uses a series of cross members to support a plurality of panels that are attached to and supported by the cross members. During assembly, the panels are arched to provide sufficient structural support for the structure. Because the panels are assembled over an open tank, they are difficult to position and bend to provide the desired arch shape, and support members remain in or over the tank after removal of the panels. Also, the individual panels are not easily gripped and moved or placed. Moreover, the flexure characteristics of the individual panels, necessary to provide the arched structure when installed, significantly increases field assembly problems. Additionally, arched structures do not provide a desirable planar walking surface. Arched or domed walking surfaces are particularly disadvantageous in cold climates where the cover may be subjected to a coating of snow or ice.

The present invention is directed to overcoming the problems set forth above. It is desirable to have a sealed cover for an open tank that has a flat walking surface. It is also desirable to have such a cover that is comprised of a plurality of separately positionable self-supporting panels extending across the width of the tank. Furthermore, it is desirable to have such a tank cover wherein each of the individually positionable panels has a readily accessible handle provided at the end of each panel which is moveable to a position substantially flush with the walking surface of the cover when not required for lifting or moving the panel.

SUMMARY OF THE INVENTION

In accordance with one aspect of the present invention, a cover for an open tank has a plurality of first and second panels disposed in alternating arrangement along the tank. Each of the first and second panels extends across the tank and has a walking surface disposed on an upper surface, and ends parallel with the sidewalls of the tank. Each of the first and second panels also has sides extending perpendicular to the ends of the panels. Each of the ends of the first and second panels has an end cap which has a width sufficient to extend across at least a portion of a respective wall of the tank, and a groove extending along a lower surface of the end cap that is adapted to receive a seal member therein. Each of the sides of the first and second panels is mateable with the side of an adjacently disposed alternating one of the first and second panels, with each of the second panels being interlocked along at least one side with the mateable side of a respective adjacently disposed first panel. A somewhat modified first or second panel is disposed adjacent to the end wall at each end of the tank, and has a flange extending outwardly from the respective panel over the adjacent wall of the tank. The flange of each of the panels disposed adjacent to the end walls of the tank also has a groove extending along a lower surface of the flange that is adapted to receive a seal member therein. The cover further includes a plurality of first seal members each of which is disposed in a groove of a respective end cap, a plurality of second seal members, each of which is disposed along mating sides of adjacently disposed first and second panels, and a plurality of third seal members, each of which is disposed in the groove in the flange of each of the panels disposed adjacent the end walls of the tank.

Other features of the cover for an open tank, embodying the present invention, include each of the end caps of the first and second panels having an open-sided cylindrical channel formed along the upper surface of the end cap and extending along the length of the end cap. Each of the first and second panels also has an elongated plate having a cylindrical edge, coaxially formed about an axis extending along the length of one side of the plate, that is rotatably disposed in the cylindrical channel formed on the upper surface of the end cap of the respective panel. The elongated plate is rotatable about the axis between a horizontal position at which the elongated plate is disposed in a plane substantially flush with the walking surface of the respective panel, and a vertical position. Moreover, each of the elongated plates has at least one opening adapted to provide a means for gripping the elongated plate and lifting the respective panel to which the elongated plate is rotatably mounted.

In another aspect of the present invention, a horizontally disposable cover for an open tank includes a plurality of rectangular first and second panels that are arranged in alternating relationship with respect to each other over the tank. Each of the first and second panels has longitudinally spaced apart ends and transversely spaced apart sides that are mateable with an adjacent one of the first or second panels, and an end cap disposed at each end of the respective panel. Each of the first panels has a Z-beam extending along each side of the first panel, a plurality of transversely disposed stiffeners each having spaced apart ends respectively attached to one of the Z-shaped beams, and a plurality of adjacently disposed top plates, each comprising integrally formed horizontally and vertically disposed portions. The horizontally disposed portion of each of the top plates has a walking surface and an edge horizontally spaced from the vertically disposed portion of the top plate. The vertically disposed portion of each of the top plates has a lower edge attached to a horizontally disposed top flange of each of the transverse stiffeners, and an upper end that is adapted to receive the edge of the horizontally disposed portion of an adjacently disposed top plate. Each of the second panels has a channel beam extending along each side of the second panel, a plurality of transversely disposed stiffeners each having spaced apart ends respectively attached to one of the channel beams, and a plurality of adjacently disposed top plates having the same construction as the top plates of the first panel.

Other features of the tank cover embodying the present invention include the Z-shaped beams, extending along the sides of each of the first panels, having a lower flange that extends outwardly from a respective side of the first panel with an upwardly projecting rim formed along an outwardly spaced edge of the lower flange. Each of the channel beams extending along the sides of the second panels has a lower flange that extends inwardly from a respective side of the respective panel and is adapted to be received within the rimmed lower flange of a Z-shaped beam of an adjacently disposed first panel.

Other features of the tank cover embodying the present invention include the Z-shaped beams of the first panels and the channel beams of the second panels each having a web extending between respective upper and lower flanges of the beams. A pair of vertically spaced apart cylindrical chases extend along each of the webs of the Z-shaped and the channel beams, on a side of the webs facing inwardly from the side of the respective first and second panels. The cylindrical chases are spaced apart at a distance substantially equal to the distance at which top and bottom flanges of the transversely disposed stiffeners are vertically spaced apart.

In another aspect of the present invention, a cover comprises a plurality of separate panels that are mountable across the top of an open tank. The panels have end caps that extend across the respective ends of each of the panels. Each of the end caps has an open-sided cylindrical channel formed on an upper surface of the end cap, and extending along the length of the end cap. Also, selected ones of the panels have an elongated plate on which a cylindrical edge is coaxially formed about an axis extending along the length of one side of the elongated plate and is rotatably mounted in the cylindrical channel formed on the upper surface of selected end caps. The elongated plate is rotatable about the axis between a horizontal position at which the elongated plate is substantially coplanarly disposed with respect to a walking surface of the panel, and a vertical position. Each of the elongated plates has at least one opening providing a means for gripping the elongated plate and lifting the panel when the elongated plate is in the vertical position.

Other features of the multi-panel cover, embodying the present invention, include the walking surface of each of the panels being substantially flat and the elongated plates being disposed at an outer extremity of each end of the panels and having the spaced apart openings provided therein.

BRIEF DESCRIPTION OF THE DRAWINGS

A more complete understanding of the structure and operation of the present invention may be had by reference to the following detailed description when taken in conjunction with the accompanying drawings, wherein.

DETAILED DESCRIPTION OF PRESENTLY PREFERRED EXEMPLARY EMBODIMENTS

Figure 1:
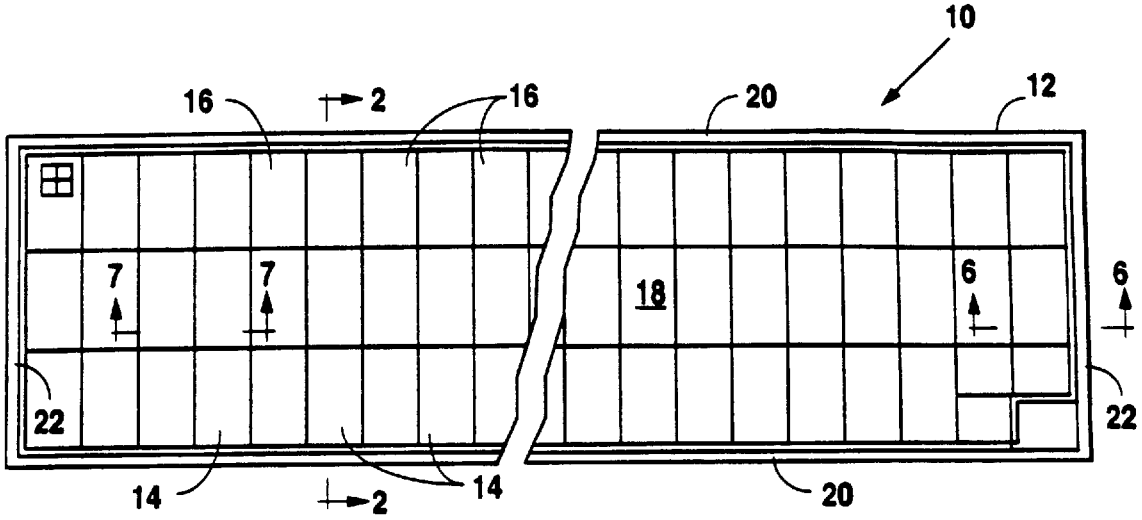
FIG. 1 is a plan view of a tank cover embodying the present invention.
Figure 2:
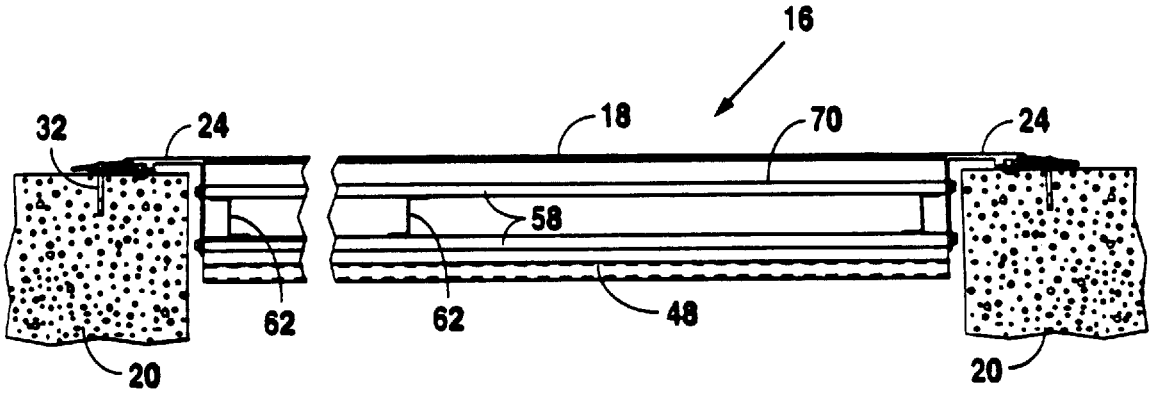
FIG. 2 is a cross-sectional view of the tank cover embodying the present invention, taken along the line 2—2 of FIG. 1.
Figure 6:
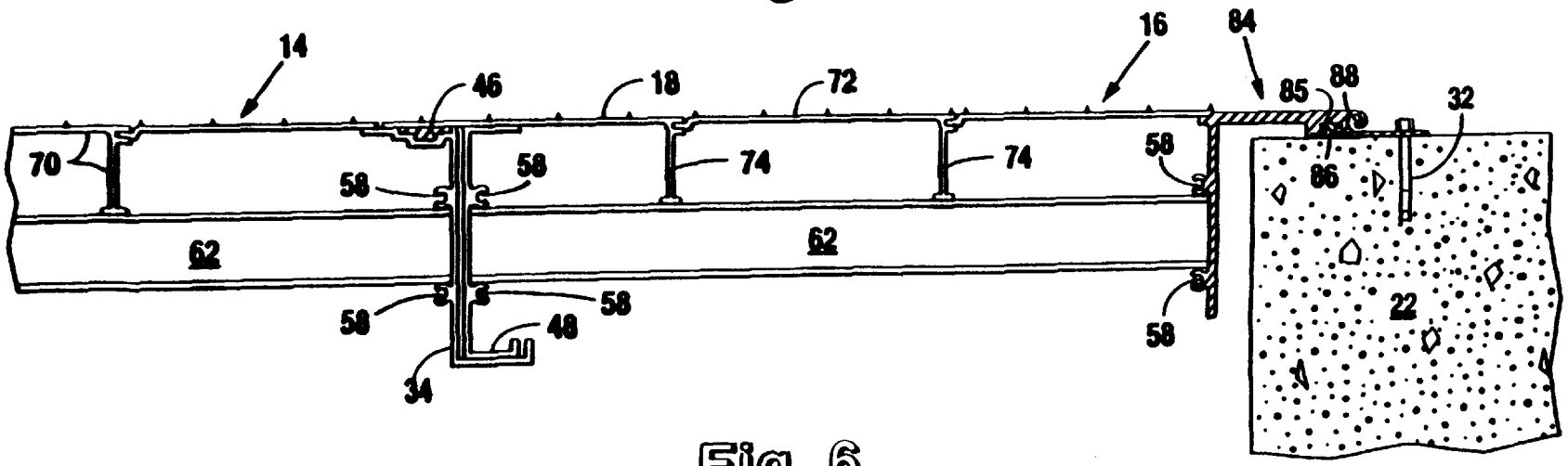
FIG. 6 is a partial sectional view of the tank cover embodying the present invention, taken along the lines 6—6 of FIG. 1.
Figure 7:
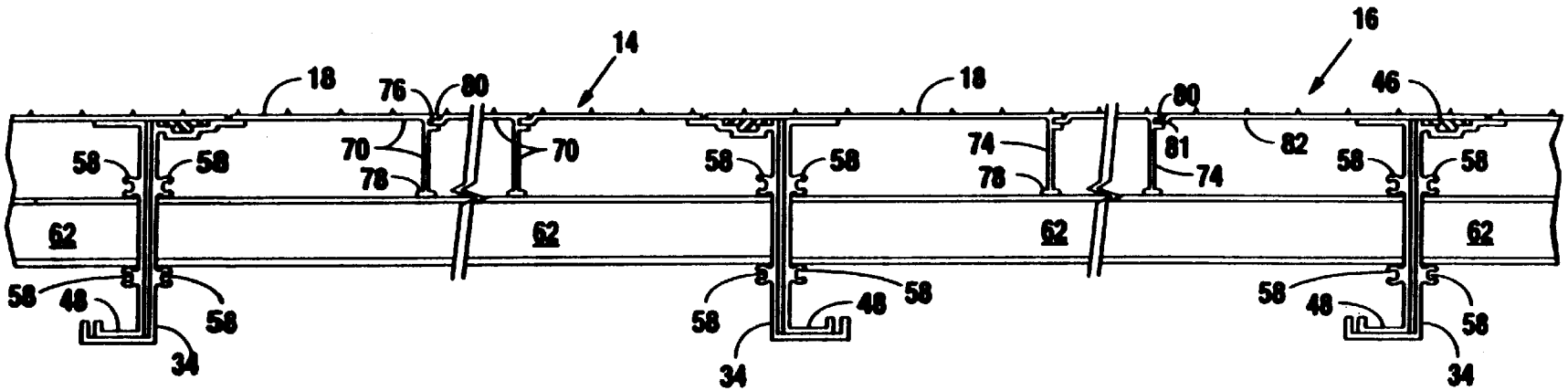
FIG. 7 is a sectional view of the tank cover embodying the present invention, taken along the line 7—7 of FIG. 1.

In a first embodiment of the present invention, a cover 10 for a rectangular open tank or basin 12 is shown in FIG. 1, and is formed of a plurality of adjacently disposed first, or female, panels 14 and second, or male, panels 16 arranged in alternating relationship along the length of the tank 12. Each of the first and second panels 14, 16 extends across the width of the tank 12, is self-supporting, and has a walking surface 18, as best shown in FIGS. 2, 6 and 7, formed on an upper surface of each of the panels 14, 16. Importantly, when the first and second panels 14, 16 are joined together, as described below in greater detail to form the cover 10, the resulting structure is substantially flat, i.e., planar, with, desirably, a textured or ribbed bi-directional non-skid surface to provide resistance against slipping when walking across the cover 10. Importantly, in the presently described preferred embodiment, there are no cross beams, protrusions, handles, or other structures extending above the planar surface 18 of the cover 10 that would present a hazard when walking across the cover 10.

Advantageously, the cover 10 embodying the present invention is formed of extruded members. As described below in detail, predefined ones of the extruded members have formed grooves adapted to receive appropriate seals so that when the cover 10 is installed on the tank 12, the cover 10 provides a substantially gas-tight cover over the tank 12. Desirably, the extruded members are formed of a relatively lightweight metallic material, such as aluminum. Furthermore, each of the first and second panels 14, 16 is provided, as described below in greater detail, with handles at the extreme ends of each of the panels which enable the respective panels to be easily lifted, either manually or mechanically, during installation or removal from the tank 12. Also, because the panels 14, 16 are individually self-supporting, it is typically not necessary for a worker to stand on narrow pre-placed support beams or partially assembled structures over an otherwise open tank, during assembly of the cover over the tank.

Figure 3:
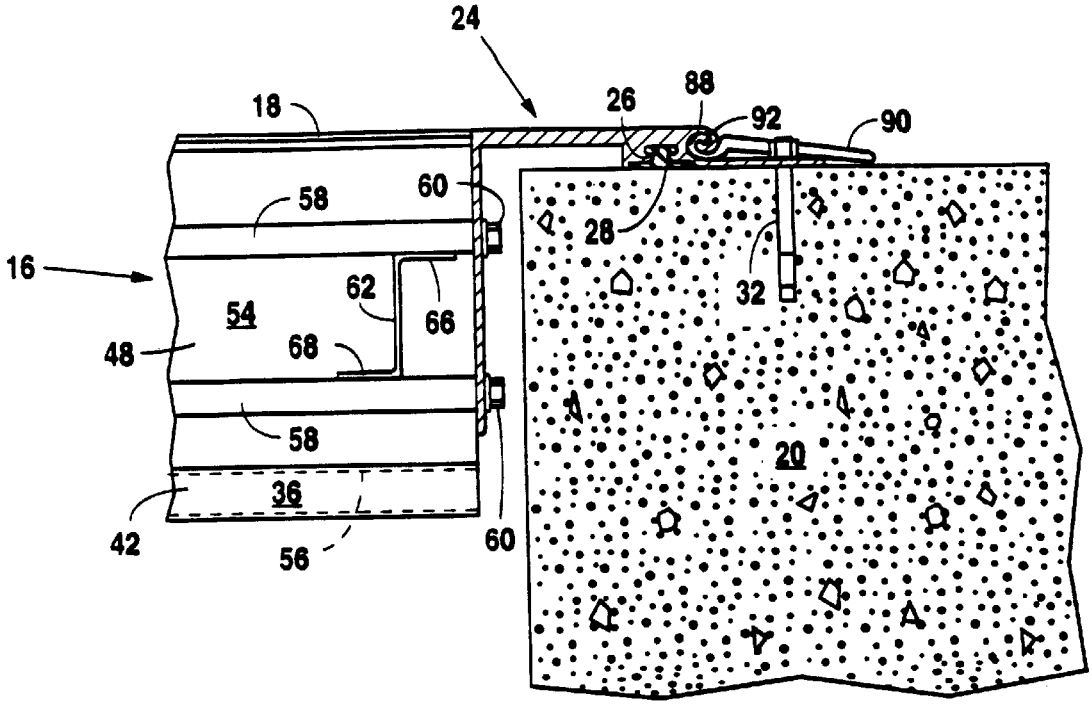
FIG. 3 is a sectional view of one end of the panel embodying the present invention, showing a lifting handle, rotatably mounted to an end cap of a panel of the cover, in a horizontal position.
Figure 4:
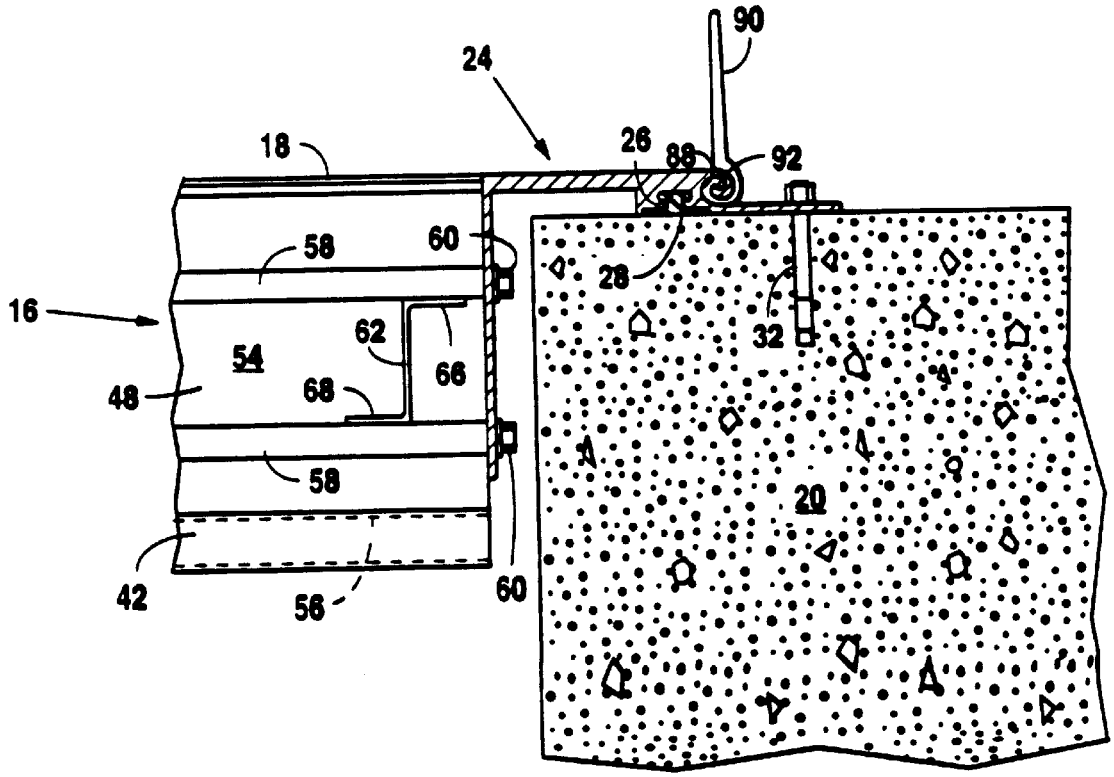
FIG. 4 is a sectional view of one end of the panel embodying the present invention, showing a lifting handle, rotatably mounted to an end cap of a panel of a cover, in a vertical or lifting position.

Each of the first and second panels 14, 16 is typically rectangularly shaped with ends parallel with the side walls 20 of the tank 12 and sides that extend perpendicular to the ends of the panels 14, 16 and parallel with the end walls 22 of the tank 12. As best shown in FIGS. 2–4, each of the ends of the first and second panels 14, 16 has an end cap 24 which has a width sufficient to extend over at least a portion of the respective side wall 20 of the tank 12. Each of the end caps 24 also has a groove 26, extending along a lower surface of the end cap, that is adapted to seal members 28 therein. The first seal members 28 are preferably formed of an elastomeric material, such as neoprene, and provide a seal between a respective end cap 24, in which the first seal member 28 is positioned, and the top of a corresponding side wall 20 of the open tank 12 when the respective first or second panel 14, 16 is disposed across the tank 12.

Each of the end caps 24 of the second panels 16, and the end caps 24 of the first panels 14 if so desired, has an aperture 30 formed therein for receiving an anchor bolt 32 mounted at a predefined position in the side wall 20 of the tank 12. When the second panel 16 is installed over the tank 12, the panel is securely attached to the side wall 20 of the tank 12 by a nut installed on the bolt 32. The nut is tightened so that it exerts sufficient force on the end cap 24 to compress the first seal member 28 between the end cap 24 of the respective second panel 16, as well as each adjacently disposed first panel 14 and the side wall 20 of the tank 12. Because each of the second panels 16 abuts an upper portion of each adjacently disposed first panel 14, as described below in greater detail, it is typically only necessary to anchor the second panels to the tank 12 with bolts 32 due to the second panels 16 applying a compressive force on the first seal member 28 disposed in the end cap 24 of the adjacently disposed first panels 14.

When arranged for interior use, i.e., not positioned adjacent an end wall 22 of the tank 12, each of the sides of the first and second panels 14, 16 is mateable with the side of an adjacently disposed alternating one of the first or second panels 14, 16. More specifically, each of the second panels 16 has a channel beam 48 disposed along each side that is mateable with a Z-shaped beam 34 disposed along the sides of the first panels 14. The channel beams 48 and the Z-shaped beams 34 have spaced apart ends that are respectively attached to one of the end caps 24, as shown in FIGS. 2–4.

Figure 8:
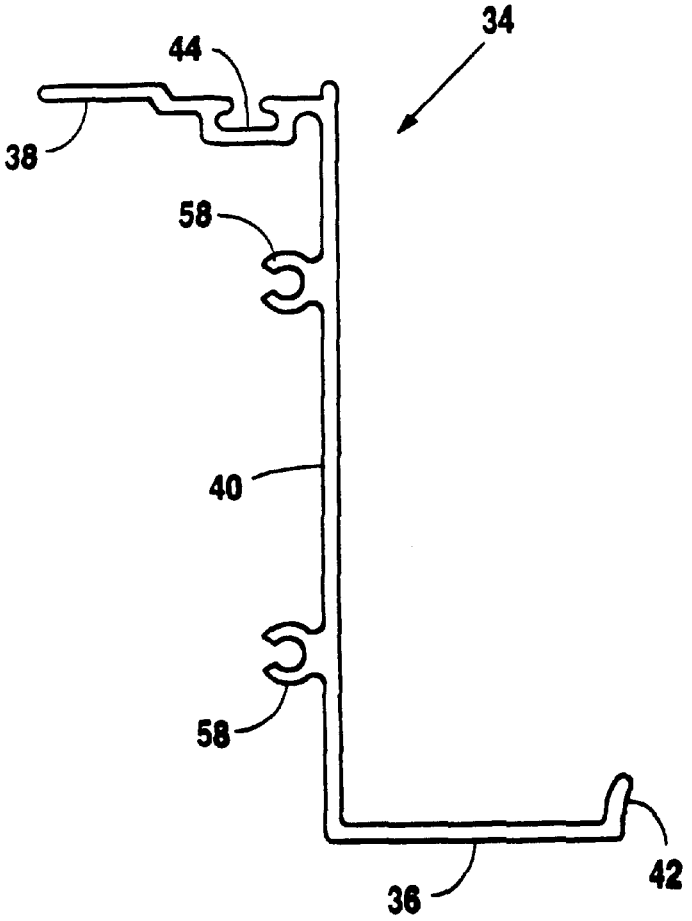
FIG. 8 is an enlarged view of a Z-shaped beam extending along each side of a first set of panels included in the tank cover embodying the present invention.

An enlarged detail of the Z-shaped beam 34 is shown in FIG. 8. Each of the Z-shaped beams 34, extending along the sides of each of the first panels 14, has a lower flange 36 extending outwardly from a respective side of first panel 14, an upper flange 38 extending inwardly from the respective side of the first panel 14, and a vertically disposed web 40 extending between the lower flange 36 and the upper flange 38. The lower flange 36 has an upwardly projecting rim 42 formed along the lower flange 36 and spaced at a predefined distance from the web 40 of the Z-shaped beam 34. The upper flange 38 of each of the Z-shaped beams 34 has a groove 44 extending along the length of the upper flange 38 that is adapted to receive an elongated seal member 46 therein.

Figure 9:
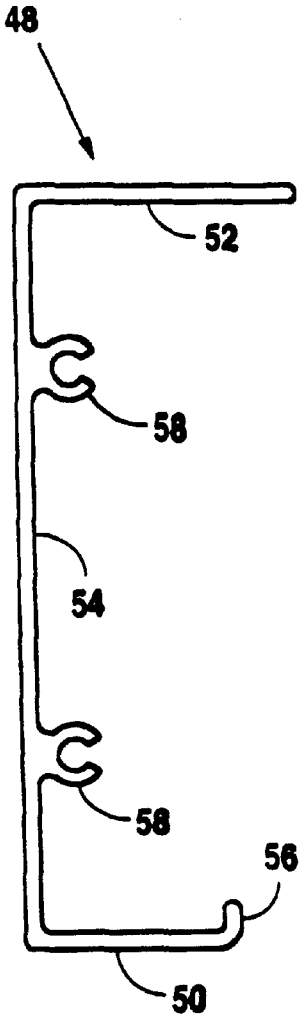
FIG. 9 is an enlarged view of a channel beam extending along each side of a second set of panels included in the tank cover embodying the present invention.

Each of the second panels 16 has a channel beam 48, as best shown in FIG. 9, disposed along the sides of the second panels, with respective ends attached to one of the end caps 24. The channel beams 48 have a lower flange 50 extending inwardly from the side of the second panel 16, an upper flange 52 also extending inwardly from the respective side of the second panel 16, and a vertically disposed web 54 extending between the lower flange 50 and the upper flange 52. The lower flange 50 has an upwardly projecting rim 56 spaced from the web 54 of the channel beam 48 at a distance that is less than the predefined distance at which the upwardly projecting rim 42, formed along the lower flange 36 of the Z-shaped beam 34, is spaced from the web 40 of the Z-shaped beam 34. Thus, when a second panel 16 is positioned between two first panels 14, the lower flange 50 of the channel beam 48 of the second panel 16 mates with, and nests in interlocking relationship with, the lower flanges 36 of the Z-shaped beam 34 of the adjacently disposed first panels 14, as shown in FIG. 6. Thus, the channel beams 48 of the second panels 16 are transversely interlocked with the Z-shaped beams 34 of the first panels 14. This prevents the first and second panels from moving laterally with respect to each other. Longitudinal movement of the respective panels 14, 16 is prevented by the respective side walls 20 of the tank 12. Thus, the first and second panels 14, 16, are interlocked together transversely, and retained longitudinally, in such a manner that relative movement between the panels 14, 16 is restricted during any flexure of the panels, such as by walking across the walking surface 18 after the cover 10 is in place.

The webs 40, 54 of the respective Z-shaped beams 34 and channel beams 48 have a pair of vertically spaced apart hollow, cylindrical chases, or channels, 58 extending along a surface of each of the webs 40, 54 that faces inwardly from the respective side of the first or second panel 14, 16. The chases 58, as shown in section in FIGS. 8 and 9, provide a convenient attachment structure for a screw 60 that is inserted through a hole provided in the end caps 24 and threaded into the respective chase 58 of a Z-shaped beam 34 or channel beam 48, as shown in FIGS. 3 and 4. Thus, the Z-shaped beam members 34 of the first panels 14 and the channel beam members 48 of the second panels 16 are rigidly attached to the end caps 24 extending across the respective ends of the first panels 14 and second panels 16. The chases 58 are spaced apart at a predetermined distance so that they support the flanges on transverse stiffeners 62 that extend between the respective Z-shaped beam members 34 or channel beams 48, as described below.

Each of the first panels 14 and second panels 16 has a plurality of the transversely disposed stiffeners 62 which have spaced apart ends that are respectively attached to a Z-shaped beam member 34, if a component of the first panel 14 construction, or a channel beam 48 if a component of a second panel 16 structure. Although shown as Z-shaped beams, the stiffeners 62 may have other structural shapes such as a channel beam or I beam. The respective ends of the stiffeners 62 are supported between the pair of spaced apart cylindrical chases 58 extending along the inwardly facing surface of the webs 40, 54 of the Z-shaped beam member 34 or channel beam 48. The stiffeners have an upper flange 66 that is vertically spaced from a lower flange 68. As noted above, the support chases 58 formed on the inwardly facing surfaces of the respective webs 40, 54, are spaced apart at a distance substantially equal to the distance at which the upper and lower flanges 66, 68 of the transversely disposed stiffeners 62 are vertically spaced apart. Desirably, after insertion of the respective end of the stiffener 62 between the cylindrical chases 58, the respective end is spot-welded to the chase 58 to maintain the stiffener 62 in fixed relationship with the respective Z-shaped beam member 34 or channel beam 48.

Each of the first and second panels 14, 16 also includes a plurality of adjacently disposed top plates 70, each of which has an integrally formed horizontally disposed portion 72 and a vertically disposed portion 74 that extends downwardly from one side of the horizontally disposed portion 72. The horizontally disposed portion 72 of the top plates 70 has an upper surface that is textured to provide a bi-directional non-skid walking surface 18, and a tongue edge 76 that is horizontally spaced from the side of the top plate 70 from which the vertically disposed portion 74 projects downwardly.

The vertically disposed portion 74 of each of the top plates 70 has a lower edge 78 that is attached, preferably by a spot weld, to the upper flange 66 of the stiffeners 62 positioned below the top plate 70, and an upper end 80 that has a groove 81 adapted to receive the horizontally spaced tongue edge 76 of an adjacently disposed top plate 70, as best shown in FIG. 6.

The top plates 70 disposed along one side of the second panels 16, adjacent to one of the channel beams 48, extend across the upper flange 52 of the channel beam 48 and beyond the flange 52, as shown in FIG. 6, a distance sufficient to cover the second seal member 46 disposed in the groove 44 formed in the upper flange 38 of an adjacently disposed Z-shaped beam 34, thereby compressing the seal 46.

Also, as best shown in FIG. 7, a horizontally disposed filler plate 82 is disposed along the opposite side of the second panels 16. The plate 82 has an upper surface identical to the walking surface 18 on each of the top plates 70 and extends between an outer portion of the upper flange 38 of one of the Z-shaped beams 34 of a first panel 14 and the groove 81 disposed in the upper end 80 of the vertically disposed portion 74 of a top plate 70 spaced from the edge-mounted Z-shaped beam 34.

When one of the first panels 14, or second panels 16, is positioned at either one of the ends of the tank 12, as shown in FIG. 6, the side of the respective first or second panel 14, 16 adjacent the end wall 22 of the tank 12 is modified to include a flange 84 that extends outwardly from the respective panel 14, 16 and over the adjacent end wall 22. The flange 84 has a construction similar to that of the end caps 24, i.e. a groove 85 formed in the bottom surface of the flange 84 that is adapted to receive a third seal member 86 that provides a sealed joint between the flange 84 and the side of the panel adjacent end wall 22 when the side of the panel is bolted to the end wall 22.

Importantly, each of the end caps 24 disposed adjacent the side walls 20 of the tank 12, and the flange 84 disposed adjacent the end walls 22 of the tank 12, has an open-sided cylindrical channel 88 formed on an upper surface that extends along the length of the end cap 24 or flange 84. In a preferred embodiment of the present invention, an elongated plate 90 has a cylindrical edge 92 coaxially formed about an axis extending along the length of one side of the elongated plate 90, and is rotatably disposed in the cylindrical channel 88 formed on the upper surface of the respective end cap 24 or flange 84. The elongated plate 90 is assembled with the end cap 24 by inserting one end of the cylindrical edge 92 into an end of the cylindrical channel 88 and then sliding the elongated plate 90 to the desired position along the channel 88. Preferably, the elongated plate 90 has a length that is somewhat less than the length of the end cap 24 in which the elongated plate is mounted. The elongated plates 90 are then rotatable within the respective cylindrical channels 88 between a horizontal position at which the elongated plate is disposed in a plane substantially flush with the walking surface 18 of adjacently disposed first or second panels 14, 16, as shown in FIG. 3, and a vertical position as shown in FIG. 4.

Each of the elongated plates 90 also has at least one opening 94 that is adapted to provide a means for gripping the elongated plate 90, either manually or with grappling hooks, when the elongated plate 90 is in the vertical position, and lifting the respective panel 14, 16 to which the elongated plate 90 is rotatably mounted. Thus, the elongated plate 90 provides an easily accessible handle for lifting the panels 14, 16 from the respective ends of the panel, thereby negating the need for bending over the top of the tank or awkwardly stretching to grip handles that may be positioned inwardly from the edge of the cover 10.

Figure 5:
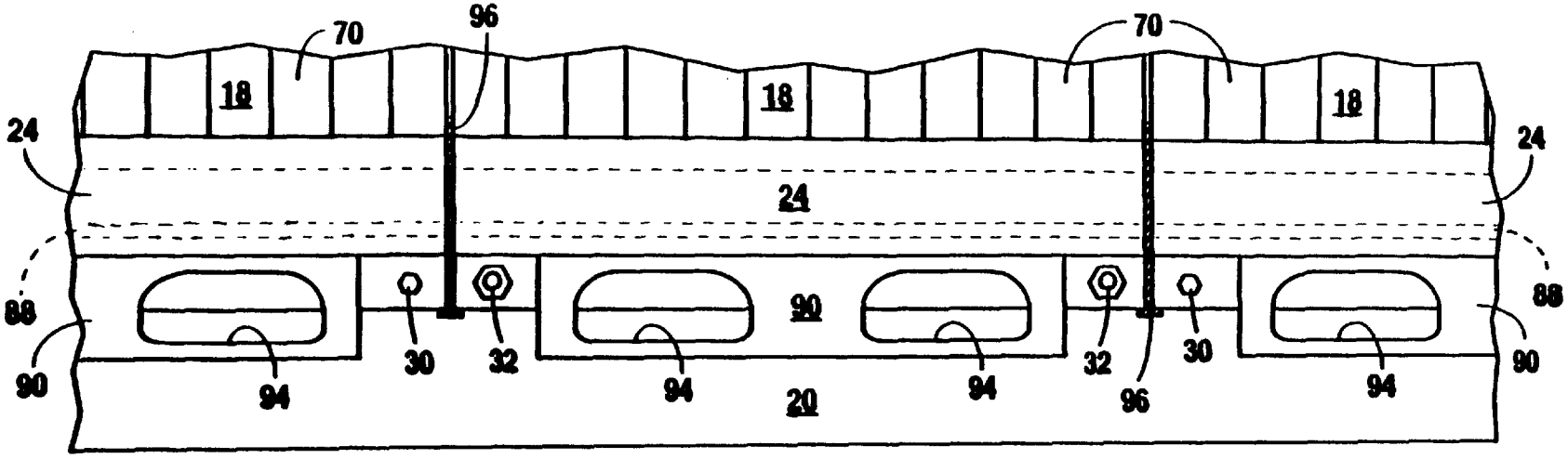
FIG. 5 is a partial plan view of the ends of the panels comprising the tank cover embodying the present invention, showing handles rotatably attached to the ends of the panels in a stored position.

The cover 10 is easily assembled over a tank 12 by first placing a predesignated member of the first panels 14 along the length of the tank 12. This can be easily carried out by lifting the panels at each end, using the handles 94 provided in the elongated plate 90 and lowering the first panels onto the tank 12 until the end caps 24 are resting on the corresponding side wall 20. Preferably a spacer bar, having a width equal to that of the second panels 16, is used to precisely position first panels 14 at a distance apart equal to the width of the second panels 16. After the first panels 14 have been positioned, the second panels 16 are lifted, using the handles 94 provided at each end of the panel 16, and lowered into place between the prepositioned first panels 14. When properly positioned, the lower flange 50 of each of the channel beams 48 is nested into the lower flange 36 of an adjacent Z-shaped beam member 34. Also, the second seal members 46 disposed in the groove 44 formed in the flanges 38 of the Z-shaped beam members 34 and compressed between the upper flange 38 of the Z-shaped beam member and an adjacently disposed portion of a second panel 16. Desirably, a fourth seal member 96 is positioned between adjacently disposed end caps 24 of the first and second panels 14, 16, as shown in FIG. 5, to provide a seal between the respective end caps 24 of the first and second panels 14, 16.

After positioning the first and second panels 14, 16 over the thank 10 and the fourth seal members 96 between adjacently disposed end caps 24, the second panels 16 are bolted to the respective side walls 20 of the tank 12 in the manner described above, and tightened an amount sufficient to compress the first seal member 28 in the respective second panels 16 and in the adjacently disposed first panels 14. Also, nuts on the anchor bolts 32 extending through the flanges 84 at the end walls 22 of the tank 12, are tightened to compress the third seal member 86.

Thus, it can be seen that the cover 10 when completely assembled and installed over an open tank 12 is sealed completely around its perimeter by the first seal members 28 disposed between the end caps 24 and the side walls 20, by the second seal members 46 extending along the longitudinal joints between the adjacently disposed sides of first and second panels 14, 16, by the third seal members 86 disposed between the flange 84 and the end walls 22 of the tank 12, and by the fourth seal members disposed between adjacently positioned end caps 24 of the first and second panels 14, 16.

It can be readily seen that the structure of the cover 10, embodying the present invention, is comprised of preassembled panels that require only spot or stitch welding, with no structural welding required in the field. The first and second panels 14, 16 are self-supporting for spans up to approximately 25 feet (8.2 m). Therefore, the panels 14, 16 can be used on rectangular structures having a width less than 25 feet (8.2 m) and on round structures having a diameter less than 25 feet (8.2 m). When used in round or curved sidewall structures, the panels 14, 16 are mitered to match the general shape of the peripheral wall of the tank or basin. Thus, although some of the panels 14, 16 may be mitered when used on round or curved wall structures, the panels 14, 16 spaced inwardly from the peripheral wall of the tank have the above-described rectangular construction. Other tank shapes suitable for the cover 10 embodying the present invention include T-shaped and L-shaped open structures.

In the preferred embodiment of the present invention the cover 10 has conveniently positioned handles disposed at each end of each panel so that the individual panels can be easily lifted and moved by two people standing along the side of the tank. Moreover, the above-described and claimed handles are not recessed in the cover itself, whereby water and other debris may accumulate in the handle recess, nor do the handles project above the walking surface of the cover 10. In other arrangements, the panels 14, 16 may be mounted above the walls of the tank and lift handles provided directly on a vertical surface of the end wall. Also, the cover 10 embodying the present invention is formed almost entirely of extruded beams or other easily fabricated shapes, making the structure economical to manufacture. Moreover, the first and second panels 14, 16 do not require bending into an arch to provide sufficient self support when the ends are mounted on the walls of a tank having a span of less than about 25 feet (8.2 m).

Although the present invention is described in terms of a preferred exemplary embodiment, those skilled in the art will recognize that changes in those embodiments may be made without departing from the spirit of the invention. Such changes are intended to fall within the scope of the following claims. Other aspects, features and advantages of the present invention may be obtained from the study of this disclosure and the drawings, along with the appended claims.

What we claim is:

1. A flat cover for an open tank having side walls defining the width of the tank and end walls defining the length and ends of the tank, said cover comprising:

a plurality of first and second panels disposed in alternating arrangement for disposition along the length of the tank, each of said first and second panels adapted for extension across the width of the tank and having a walking surface disposed on an upper surface thereof and having ends adapted to be parallel with the side walls of the tank and sides extending perpendicular to said ends, an end cap disposed at each end of the first and second panels, each end cap having a width sufficient to extend over at least a portion of one of the side walls of the tank and a groove extending along a lower surface of the end cap and adapted to receive a seal member therein and the end caps of said second panels being adapted for attachment to one of the side walls of the tank, one of said panels adapted to be disposed adjacent the end wall at each end of the tank and at least one of said panels being an interior panel positionable in spaced relationship from said end walls, said interior panel having sides that are interlockably mateable with the side of the adjacently disposed panel, and said panels disposable adjacent the end walls having a flange extending from one of the sides of each of the panels in a direction away from said panels for a distance sufficient to extend over at least a portion of the end walls of said tank, each flange having a groove extending along a lower surface of the flange and adapted to receive a seal member therein;

a plurality of first seal members each of which is disposed in the groove in each of the end caps, a plurality of second seal members disposed between the first and second panels and adapted to provide a sealed joint therebetween; and a plurality of third seal members each of which is disposed in the groove in the flange of each of the panels disposable adjacent the end walls of the tank.

2. The flat cover for an open tank, as set forth in claim 1, wherein each of the end caps of said first and second panels has a predefined length and an open-sided cylindrical channel formed on an upper surface of each end cap and extending along the length of said end cap, and an elongated plate having a predefined length, said elongated plate having a cylindrical edge coaxially formed about an axis extending along the length of one side of said elongated plate and rotatably disposed in the cylindrical channel formed on the upper surface of the end caps and rotatable about said axis between a horizontal position at which said elongated plate is disposed in a plane substantially flush with the walking surface of one of the panels and a vertical position, each of said elongated plates having at least one opening adapted to provide a means for gripping said elongated plate and lifting the respective panel to which said elongated plate is rotatably mounted.

3. A flat cover for an open tank having walls defining an opening, comprising:

a plurality of substantially rectangular first panels each having longitudinally spaced apart ends and transversely spaced apart sides, an end cap disposed at each end of the first panels, a Z-shaped beam extending along each side of the first panels and having ends, one of the ends of each Z-shaped beam being attached to one of said end caps, a plurality of transversely disposed stiffeners each having spaced apart ends, one of the ends of each stiffener being attached to one of the Z-shaped beams of the first panels, the stiffeners each having vertically spaced apart horizontally disposed top and bottom flanges, and a plurality of adjacently disposed top plates each comprising integrally formed horizontally and vertically disposed portions, said horizontally disposed portion having a walking surface and an edge horizontally spaced from the vertically disposed portion of the top plate and said vertically disposed portion having a lower edge attached to the horizontally disposed top flange of each of said transverse stiffeners of the first panels and an upper end adapted to receive the edge of the horizontally disposed portion of the adjacently disposed top plate;

a plurality of substantially rectangular second panels each having longitudinally spaced apart ends and transversely spaced apart sides, an end cap disposed at each end of the second panels, a channel beam extending along each side of the second panels and having ends, one of the ends of each channel beam being attached to one of said end caps, a plurality of transversely disposed stiffeners each having spaced apart ends, one of the ends of each stiffener being attached to one of the channel beams, the stiffeners each having vertically spaced apart horizontally disposed top and bottom flanges, and a plurality of adjacently disposed top plates each comprising integrally formed horizontally and vertically disposed portions, said horizontally disposed portion having a walking surface and an edge horizontally spaced from the vertically disposed portion of the top plate and said vertically disposed portion of each said top plates having a lower edge attached to the horizontally disposed top flange of each of said transverse stiffeners of the second panels and an upper edge adapted to receive the edge of the horizontally disposed portion of the adjacently disposed top plate; and, said first and second panels being arranged in alternating relationship with respective sides of the alternating first and second panels being adjacently disposed, and the channel beam extending along the sides of said second panels being mateable with respective ones of the Z-shaped beams disposed along the sides of said first panels.

4. The flat cover for an open tank, as set forth in claim 3, wherein each of said end caps of said first and second panels has a length extending between the transversely spaced apart sides of the respective panel and a width sufficient to extend over at least a portion of one of the walls of said open tank when the respective panel of the cover is disposed across said open tank, each of said end caps having a groove defined in a lower surface of said end cap that receives an elongated seal member, each of said seal members being disposed in sealing relationship between the end cap in which the seal member is received and the one of said walls of the open tank when the respective panel is disposed across said open tank.

5. The flat cover for an open tank, as set forth in claim 4, wherein each of said end caps of the first and second panels has an open-sided cylindrical channel formed on an upper surface of each end cap and extending along a length of said end cap.

6. The flat cover for an open tank, as set forth in claim 5, wherein each of said first and second panels includes an elongated plate having a predefined length, a cylindrical edge coaxially formed about an axis extending along the length of one side of said elongated plate and rotatably mountable in the cylindrical channel formed on the upper surface of the end caps, said elongated plate being rotatable about said axis between a horizontal position at which said elongated plate is disposed in a plane substantially flush with the walking surface of the top plate of one of said first and second panels and a vertical position, and having at least one opening providing a means for manually gripping said elongated plate.

7. The flat cover for an open tank, as set forth in claim 3, wherein each of said Z-shaped beams extending along the sides of each of the first panels has a lower flange extending away from one of the transversely spaced sides of the first panels, an upper flange extending toward the one of the transversely spaced sides of the first panels, and a vertically disposed web extending between the lower and upper flanges, said lower flange having an upwardly projecting rim formed along the lower flange and spaced at a predefined distance from the web of the Z-shaped beam, and said upper flange having a groove extending along said upper flange and adapted to receive a seal member therein.

8. The flat cover for an open tank, as set forth in claim 7, wherein said web of the Z-shaped beams of the first panels has a pair of vertically spaced apart hollow cylindrical chases extending along each Z-shaped beam on a surface of the web facing toward the one of the transversely spaced sides of the first panels.

9. The flat cover for an open tank, as set forth in claim 8, wherein each of said channel beams extending along the sides of each of the second panels has a lower flange extending toward one of the transversely spaced sides of the second panels, an upper flange extending toward the one of the transversely spaced sides of the second panels, and a vertically disposed web extending between the lower and upper flanges, said lower flange having an upwardly projecting rim formed along the lower flange and spaced from the web at a distance less than the predefined distance at which the upwardly projecting rim formed along the lower flange of the Z-shaped beam is spaced from the web of the Z-shaped beam.

10. The flat cover for an open tank, as set forth in claim 9, wherein said web of the channel beams of the second panels has a pair of vertically spaced apart hollow cylindrical chases extending along each channel beam on a surface of the web facing toward the one of the transversely spaced sides of the second panels.

11. The flat cover for an open tank, as set forth in claim 10, wherein said hollow cylindrical chases are spaced apart at a distance substantially equal to the distance at which the top and bottom flanges of said transversely disposed stiffeners are vertically spaced apart, said stiffeners being attached at said ends to said pairs of said vertically spaced apart cylindrical chases.

12. A cover for an open tank comprising a plurality of separate panels that are mountable across a top of the tank, each of said panels having a walking surface and partially defined by spaced apart ends at which an end cap having a length extending across the respective ends of each panel is disposed, each end cap having an open-sided cylindrical channel formed on an upper surface and extending along the length of said end cap, each of said panels including an elongated plate having a predefined length, a cylindrical edge coaxially formed about an axis extending along the length of one side of said elongated plate and rotatably mountable in a cylindrical channel formed on the upper surface of one of said end caps, said elongated plate being rotatable about said axis between a horizontal position at which said elongated plate is substantially flush with the walking surface of the panels and a vertical position, and having at least one opening providing a means for gripping said elongated plate and lifting the panel to which said elongated plate is rotatably mounted.

13. The cover for an open tank, as set forth in claim 12, wherein each of said plates has a groove defined in a lower surface that receives an elongated seal member, each of said seal members being disposed in sealing relationship between one of said end caps in which the seal member is received and of a wall of said tank when the respective panel is disposed in covering relationship over said tank.

14. The cover for an open tank, as set forth in claim 12, wherein the walking surface of each of said panels is substantially flat and said elongated plates are disposed at an outer extremity of each end of each of said panels.

15. The cover for an open tank, as set forth in claim 12, wherein said open tank has walls defining the perimeter of the tank and each of said panels is supportable only by the walls of said tank.

* * * * *